United States Patent [19]

Clark

[11] 4,376,468

[45] Mar. 15, 1983

[54] DRILLING JAR

[76] Inventor: George M. Clark, 5112 Steadmont, Houston, Tex. 77040

[21] Appl. No.: 224,152

[22] Filed: Jan. 12, 1981

[51] Int. Cl.[3] ..... E21B 31/07

[52] U.S. Cl. ..... 175/304; 166/178; 166/237

[58] Field of Search ..... 166/99, 178, 237; 175/299, 300, 304

[56] References Cited

U.S. PATENT DOCUMENTS

| | | | |
|---|---|---|---|
| 1,885,043 | 10/1932 | Beck | 175/304 X |
| 2,610,027 | 9/1952 | Waggener | 175/304 |
| 2,903,241 | 9/1959 | Brown | 175/304 X |
| 2,963,101 | 12/1960 | Koppl | 175/304 X |
| 2,978,048 | 4/1961 | Walker | 175/304 X |
| 3,658,140 | 4/1972 | Berryman | 175/304 |

*Primary Examiner*—Stephen J. Novosad
*Assistant Examiner*—Joseph Falk
*Attorney, Agent, or Firm*—Gunn, Lee & Jackson

[57] ABSTRACT

A drilling jar to be installed in a set of drill collars in a drill string is disclosed. In the illustrated embodiment, first and second tubular members telescope relative to one another. At the upper end of the lower tubular member, a set of protruding lugs match shoulders having undercuts which permit relative rotation of the two tubular members through part of a turn, thereby permitting the two members to axially telescope whereby locking or unlocking the telescoping movement is controlled. The lower tubular member has an upwardly facing shoulder which is abutted against the lower end of the upper tubular member. This permits the two to be reciprocated and banged together to create a jar for the drill string. A dual jarring activity is developed by a cam actuated radially yieldable collet-type release mechanism that allows relative linear movement of the tubular members and permits selected jarring activity independently of or in conjunction with the lugged locking and releasing portions thereof.

13 Claims, 7 Drawing Figures

Fig. 1A
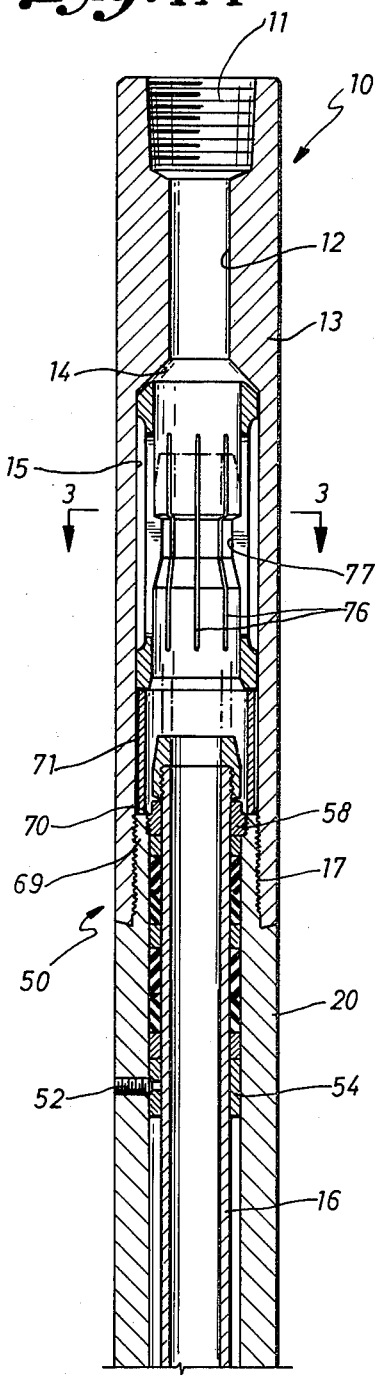
Fig. 1B
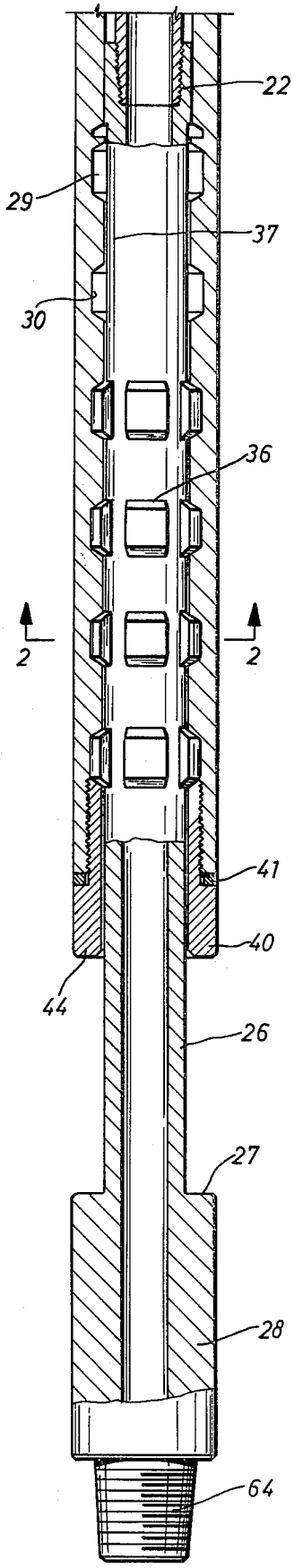
Fig. 3
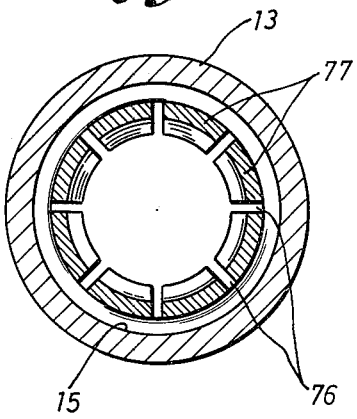
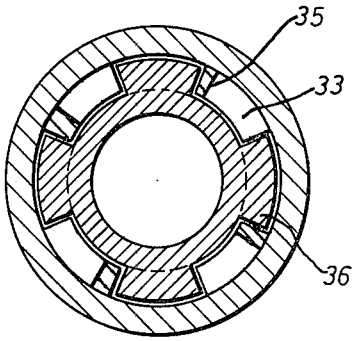
Fig. 2

DRILLING JAR

RELATED INVENTION

This invention relates to the subject matter of U.S. Pat. No. 4,113,038 issued Sept. 12, 1978 and being of common inventorship herewith.

BACKGROUND OF THE INVENTION

When an oil well is drilled, the drill bit is positioned at the bottom of the drill string and a set of heavy, thick walled drill collars is located in the drill string immediately above the drill bit. The drill collars add stiffness to the drill string, control the weight on the drill bit, and thereby control lateral drift or deviation of the drill string. The number of drill collars in a drill string will vary depending on the depth of the well, the particular formations encountered and so on.

During the drilling of an oil well which is fairly deep, there is ample opportunity for the drill string to be seized at the drill collars. Typically, this will happen when the sidewall of the hole collapses and dirt falls into the annulus around the pipe, thereby seizing the drill string at the drill collars. Even if the hole partially collapses 2 or 3 thousand feet above, the dirt, rocks, etc. which fall into the hole will accumulate just above the drill bit and thereby seize the drill string near the drill collars. Alternately, the drill bit will be deflected somewhat and drift from its intended course, thereby placing the drill string in a bind. So to speak, it forms a key seat where the drill collars are forced to the side of a part of the hole which was previously drilled, and they then tend to lock against the side of the hole. This is binding on the drill string.

When, for any of the above mentioned reasons or other reasons not named, the drill string is seized, it is necessary to free it up. There are several ways of doing this. One way is to use a jar in the drill string for purposes of imparting a substantial impact to the drill string in the immediate vicinity of the place where it is stuck. Since sticking typically occurs just above the drill bit at the drill collars, a jar mechanism in the drill string is quite advantageous.

The present invention is a jar which is installed in a drill string. It is located among the drill collars. It functions as a drill collar itself during routine drilling operations. When the drill string is stuck, the present invention can be used in conjunction with the rotary drilling apparatus to impart a jarring impact to the drill string for jarring it loose from the stuck condition.

Other devices have been provided heretofore for jars to be used in drill strings. It is believed that the present invention constitutes a significant advance over them. It is relatively simple in retrospect and, therefore, less costly in manufacturing. In addition, the present invention utilizes two basic tubular members which further simplies and defines it over the known devices. Known patents of interest are U.S. Pat. Nos. 3,001,596; 1,627,321; 1,672,464; 2,819,878; 2,819,879; 3,200,895; and 3,371,730.

BRIEF DESCRIPTION OF THE PREFERRED EMBODIMENT

The present invention is summarized as incorporating an upper mandrel and a lower mandrel which partly telescopes into the upper mandrel. The lower mandrel is provided with a set of lugs defined by encircling shoulders protruding from the lower mandrel with the encircling shoulders partly cut away. The upper outer mandrel has grooves which receive the protruding lugs. The grooves, however, are periodically interrupted so that a telescoping spline mechanism is defined. Partial rotational movement is permitted where the lugs lock into receptacles amid the splines to prevent further rotation. The upper mandrel incorporates a packer element therein which abuts and seals against a stinger pipe on the top end of the lower mandrel. The stinger pipe telescopes when the tool is in action. Otherwise, it rotates in unison with the upper mandrel. The packer around the stinger pipe is incorporated for sealing purposes to prevent drilling fluid pumped through the jar of the present invention from escaping around the packer and along the exterior of the lower mandrel telescoped into the upper mandrel. This protects the spline mechanism from drilling fluid.

A dual jarring activity is provided which allows controlled linear relative movement of the telescoping members which is separately controlled from the lugged locking and releasing mechanism of the drilling jar. The upper portion of the inner tubular member or stinger type wash pipe is provided with an enlarged detent head having a tapered upper portion. The detent head is adapted to engage internal cam release shoulders defined on a plurality of yieldable release segments of a collet-like detention cage. Upon application of a predetermined amount of force between the inner and outer telescoping members, the detention cage will be radially expanded by the tapered cam surface of the detent head and release will then occur. After certain relative linear travel has occurred, a jarring force is imparted to the drill stem as the telescoping members slam to the extent of linear movement that is allowed. The parts of the collet-like release mechanism are arranged to permit jarring both up and down with the locking lugs remaining in released position relative to the locking grooves so that linear movement of the mandrels can occur.

BRIEF DESCRIPTION OF THE DRAWINGS

FIGS. 1A and 1B together are a sectional view of the drilling jar of the present invention showing internal details of construction of an upper mandrel telescoped around a lower inner mandrel; and FIG. 2 is a sectional view along the line 2—2 of FIG. 1B showing details of construction of a spline mechanism permitting telescoping movement when properly aligned which also permits rotational movement through a fraction of a turn so that the upper and lower mandrels rotate together when desired.

FIG. 3 is a sectional view taken along line 3—3 of FIG. 1A which illustrates the collet-like configuration of the release mechanism.

DETAILED DESCRIPTION OF THE PREFERRED EMBODIMENT

Figure 6:
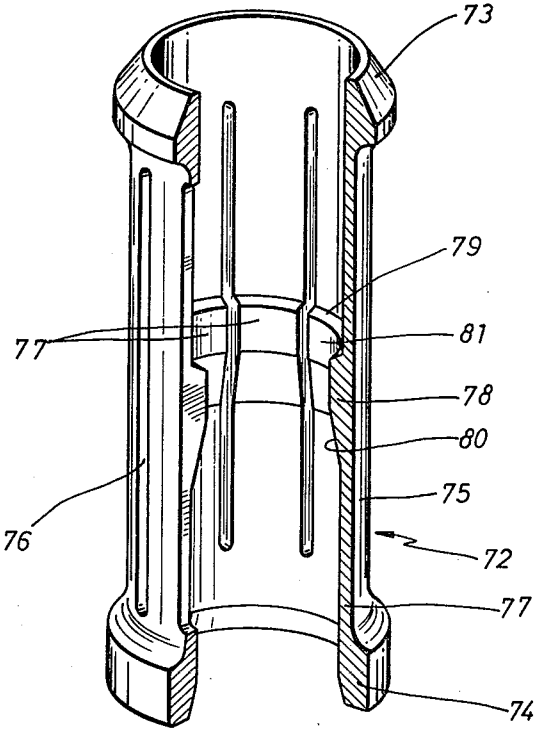
FIG. 6 is an isometric view of the detent cage structure of FIGS. 1A, 4 and 5 with a portion thereof broken away and shown in section to expose the internal structure of the detent cage.

Attention is first directed to FIG. 1A where the drilling jar 10 is illustrated. The drilling jar will be described proceeding from the top to the bottom. The drilling jar 10 is adapted to be installed in a drill string with drill collars, the number not being critical and it is connected in the drill string with the typical pin and box connection. To this end, it includes a box 11 at the upper end which opens into an axial passage 12 extending into a tubular, thick walled drill collar indicated at 13. The passage 12 extends downwardly to a shoulder 14 and a larger passage 15 is found therebelow. The enlarged passage 15 is able to receive a stinger pipe 16 on telescoping movement and also receives a secondary linear release mechanism that allows the development of jarring activity independently of a primary lug and groove controlled locking and release mechanism, both to be discussed in detail hereinbelow. The tool is dimensioned so that the stinger pipe or wash pipe 16 moves downwardly to the illustrated full lines position of FIG. 1A and it can move upwardly toward the shoulder 14 as shown in broken lines, but it does not impact against the shoulder. It is not necessary that the shoulder 14 limit upward movement of the stinger pipe 16. The shoulder merely defines the enlarged axial passage 15 and sets the limit on the upward penetration of the stinger pipe into the upper mandrel 13.

The mandrel 13 is conveniently formed of multiple pieces. They thread together with a set of threads at 17. The intermediate piece which forms the upper mandrel bears the reference numeral 20. It will be understood that the threaded connection 17 is a convenience for ease of manufacture, namely, the manufacture of the upper mandrel in two components. In addition, the threaded break is located at a point permitting easy access to the packer mechanism to be described so that it can be assembled on the interior of the upper mandrel 13. It is possible to make the mandrel 13 of one piece construction although it is more convenient and economical to make it in the manner illustrated in the drawings.

The upper mandrel is connected in a drill string and thus moves with the upper parts of the drill string. More specifically, the upper mandrel 13 is able to move with the drill string extending from the drilling jar to the well head. This enables it to be manipulated by raising and lowering the drill string utilizing the draw works at the drilling rig. By contrast, the lower mandrel which will be described is tied to the drill bit and the portion of the drill string which is stuck with the drill bit. In routine use, the upper mandrel is thus raised and lowered to be hammered against the lower mandrel to create a jarring movement. The lower mandrel serves somewhat in the fashion of an anvil so that the upper mandrel is used as a hammer against the anvil, thereby improving and accentuating the heavy jarring impact which results from use of the present invention. This jarring impact has been found to be one of the better ways to free a stuck drill string. In particular, it works well with drill strings which are stuck by the accumulation of cuttings and other debris near the bottom of the hole which close the hole and thereby seize the drill string.

The threads at 17 enable the upper mandrel to divide into two parts to enable a packer assembly to be positioned on the exterior of the stinger pipe 16. The stinger pipe 16 extends through the lower portions of the upper mandrel including the component 20. The stinger pipe 16 threads into an internally threaded coupling 22 appended to the upper end of the lower mandrel. The lower mandrel is generally identified by the numeral 25. The lower mandrel includes a portion 26 which has a smaller external diameter sized to permit it to telescope into the upper mandrel. The mandrel portion 26 thus will be described as the telescoping portion of the lower mandrel, the portion 26 terminating at an upwardly facing shoulder 27 above a thicker portion 28 at the lower end of the tool. The mandrel portion 26 thus telescopes into and out of the upper mandrel 13. This telescoping movement carries the stinger pipe upwardly and downwardly as the two major subassemblies move relative to one another. The upper mandrel 13 is formed with a number of internal grooves 29 and 30. They have preferably uniform shape, and there are at least two in the preferred embodiment, six being illustrated in the embodiment of FIGS. 1A and 1B. The grooves do not extend fully around the mandrel 26 inserted into them. Rather, the several grooves are periodically interrupted. They are interrupted by spline-like members better shown in FIG. 2 of the drawings at 33. The protruding splines extend inwardly. It will be observed that each groove is formed with sloping shoulders, and it will be further observed that the splines in the grooves which extend inwardly are themselves periodically interrupted. Restated, the grooves extend fully around the interior of the upper mandrel 13 except that they are interrupted with a longitudinal shoulder. This is better shown in FIG. 2 of the drawings where the shoulder is shown in dotted line at 35. A lug 36 carried on the lower mandrel is rotated into the groove 30 and its penetration is limited by the facing shoulder 35. Restated, the groove 30 is full and complete about 360° except that it is interrupted at each spline member by a longitudinal shoulder internally of the outer mandrel having a thickness of about ½ inch or about 5° to 10° of circumference, whichever is greater. Adjacent grooves 30 are separated by a land 37. The land is interrupted by the spline slots which enable the lugs 36 to slide upwardly and downwardly. The lugs and grooves cooperate to define a primary locking and release mechanism.

It is possible for the equipment to operate with two grooves, an intervening land, and a single lug on the lower mandrel; however, the device is used in very difficult circumstances, exposed to substantial stress, and is therefore preferably protected by the incorporation of substantial load bearing components. To this end, many grooves are utilized having abutting shoulders for carrying the several lugs. The several lugs themselves are numerous, in the preferred embodiment being found at four levels and incorporating either two or four lugs at each level.

The upper mandrel 13 terminates with a hollow threaded nut 40 which threads to the interior threads on the center component 20 thereof. A lock washer 41 is incorporated between the two for locking the nut in position. The nut 40 is inserted into the upper mandrel to lock the lower mandrel in place after it has been inserted into the upper mandrel. The nut 40 has an internal diameter which is sufficiently small to forbid the lower mandrel from feeding through it.

The grooves 29 and 30 are spaced so that, in the event the lugs 36 are in the uppermost position, the shoulder 44 at the bottom end of the upper mandrel is rested against the shoulder 27 of the lower mandrel. This closes the external gap. When the tool is in this position, the tool is adapted for a routine drilling. Routine drilling is thus initiated by no more than 45° rotation between the two parts which thereafter rotate as a unit.

It will be observed that the stinger tube 16 can telescope up against the shoulder 14, almost touching it, to thereby prevent drilling fluid from flowing on the exterior of the stinger. The apparatus incorporates a packing assembly generally identified by the numeral 50 which is received in the upper mandrel 13 and which is located immediately adjacent to the stinger. It is located so that the stinger is isolated at all times, thereby preventing the flow of drilling mud away from the annular passage through the tool itself. The apparatus includes an anchor 52 for the packer assembly. The anchor 52 holds a packer support ring 54 in position, and several chevron packings are incorporated at 56. The number of chevrons which are necessary is subject to variation. It is sufficient to include an adequate number for preventing leakage past the packer assembly. All of the chevron packings are held in position by a packing nut 58 which is threaded on the interior of the center portion 20 of the upper mandrel 13. It will be recalled that the mandrel 13 is conveniently manufactured of multiple parts and breaks at the threads 17. This exposes the packing nut 58 for easy assembly and insertion. The several components of the packing assembly are thus inserted around the pipe 16 and the last component is the packing nut 58 which is threaded into the internal threads for the purpose of locking all of the packing assembly together.

The lower end of the tool incorporates a threaded pin 64 which enables the tool to be assembled in a drill string.

The operation of the device for primary locking and unlocking will be considered hereinafter. Assume for purposes of discussion that a well has been drilled to a substantial depth and that the drill string incorporates ten drill collars above the drill bit. Further assume that the present drilling jar is located in the drill string above the eighth drill collar. Further assume that the drill string has been pinched by collapse of the well bore whereby an accumulation of debris next to the drill collars pinches or clamps the drill string against continued drilling. At this time, the lower mandrel is positioned so that the uppermost lug is received in the uppermost groove, thereby closing the shoulder 44 against the shoulder 27. As long as drilling proceeds featuring rotation to the right, the device remains closed, not in the extended position of FIG. 1B. When it is determined that the drill string has been stuck, the rotary table is reversed in operation and turned backward or to the left by a distance sufficient to enable the lug 36 to align with the splines cutting across the land 37. Before this time, the lug 36 had been jammed in a counterclockwise fashion against the shoulder 35. This is true for all of the lugs on the lower mandrel. Reverse rotation aligns the lugs to permit telescoping movement. Alignment of the lugs must be achieved first. After this alignment is achieved, the drill string can then be raised. When it is raised, the lower mandrel which is connected to the lower portions of the drill strings remains stuck. The drill string is raised with the lugs 36 moving relatively from groove to groove by passing through the spline cuts formed in the lands 37. The drill string is raised by some distance, typically a distance equal to translation of the upppermost lug to the third groove from the top. The drill string is then dropped and the shoulder 44 bangs against the shoulder 27 to impart a very substantial jarring impact to the lower part of the drill string. In particular, the impact is delivered to the stuck portion. The drill string is raised and dropped several times. Each time it is raised, a pull can be taken on the drill string to lift the entire string to see if it has been unstuck. If there is no give or movement after jarring, the jarring process is repeated time after time. The equipment of the present invention is substantially constructued to withstand the jarring impact which occurs when the shoulder 44 slams against the shoulder 27. The stinger pipe 16 telescopes almost against the shoulder 14, but they do not contact one another and therefore there is no jarring impact at that shoulder. When it has been determined that the drill string is unstuck, it can be raised completely away from the stuck area or rotated partly to the right to relock the lugs 36 in the grooves.

When jarring activities take place by raising and lowering that portion of the drill stem positioned above the mechanical jar mechanism as described above, it is obvious that the magnitude of the jarring force is dependent on several factors, including the weight of the drill pipe, the length of travel during jarring, frictional contact between the drill pipe and the wall surfaces of the well bore, etc. Drilling personnel can control the magnitude of the jarring force to some extent by dropping the drill string from selected heights within the limits allowed by a jar mechanism. In many cases, it is desirable to provide a jarring force that is of more accurately controlled magnitude. In accordance with the present invention, a mechanism for controlling the magnitude of force that is delivered during jarring activity may conveniently take the form illustrated especially in FIGS. 1A, 3, 4, 5 and 6 of the drawings. The upper portion of the wash pipe or stinger 16 is provided with an externally threaded extremity 60 that is received within an internally threaded portion 61 of a detent nut 62 that forms an enlarged head for the wash pipe structure. An internal shoulder 63 defined within the detent nut is positioned in abutting relation with the upper extremity of the wash pipe when threads 60 and 61 are in fully threaded engagement. The detent nut is in the form of an annular element defining an internal opening 64 which is positioned in registry with an internal passage 65 through which drilling fluid passing during drilling and washing operations. The detent nut is also formed to define an externally tapered surface 66 of frusto-conical configuration which represents a cam surface. The upper portion of the detent nut is rounded at 67. The lower portion of the detent nut defines an annular downwardly and inwardly tapered shoulder 68 that also functions as a cam surface as will be described hereinbelow.

The structure that makes up the threaded joint 17 is of such configuration that the external surface of the drilling jar mechanism is of cylindrical configuration. Within the drilling jar, the upwardly projecting externally threaded portion 69 develops an annular support shoulder 70 against which is seated the lower extremity of a spacer sleeve 71 which functions together with other structure as a release force control device.

Figure 5:
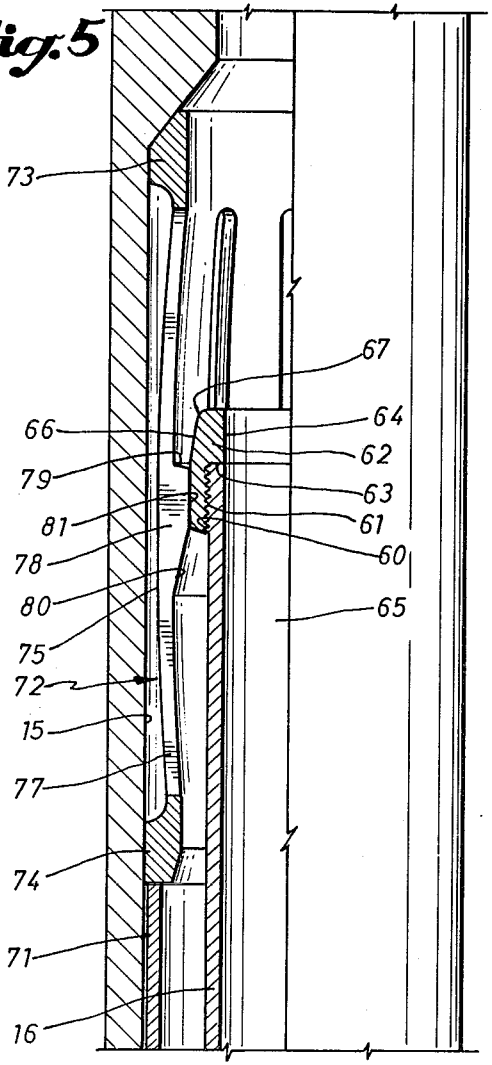
FIG. 5 is an enlarged partial sectional view as in FIG. 4 and illustrating flexing of the detent release cage structure.
Figure 4:
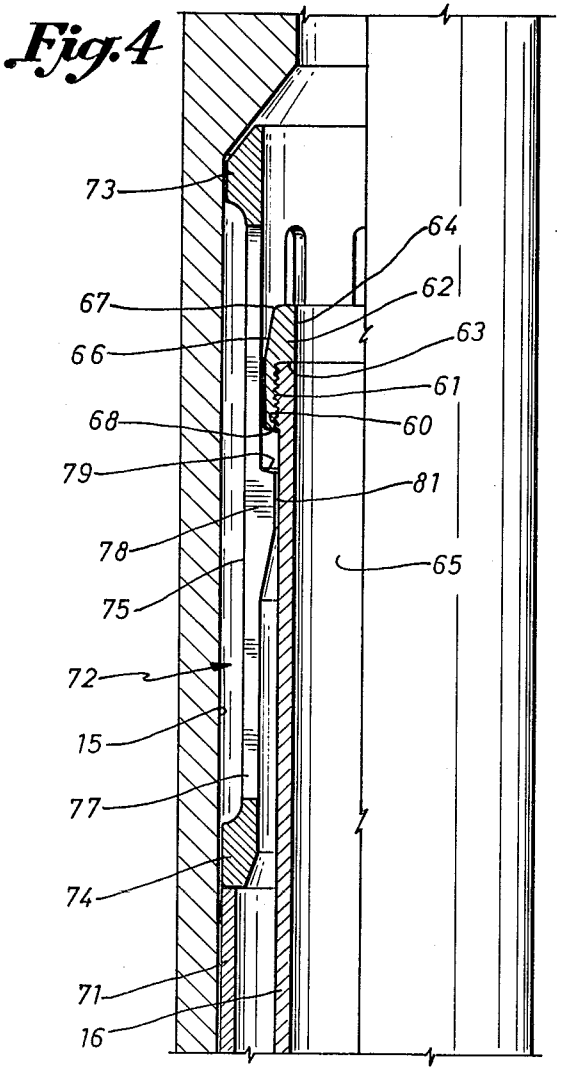
FIG. 4 is an enlarged partial cross-sectional view of the upper mandrel, illustrating the secondary jar release mechanism in detail.

Referring now to FIGS. 4, 5 and 6, within the passage or chamber 15, there is positioned an elongated generally tubular detention cage illustrated generally at 72 which includes solid annular structures 73 and 74 defining the upper and lower extremities thereof. Between these solid upper and lower annular extremities, the detention cage is provided with an intermediate collet-like locking and release section 75. To define the collet-like configuration, the intermediate section 75 is formed to define a plurality of elongated generally parallel slots 76 that separate the intermediate section into a plurality of elongated flexible ribs 77 which are integral with the upper and lower solid annular portions 73 and 74.

Intermediate the extremities of each of the flexible ribs 77, there is provided an internally extending detent portion 78 having tapered cam surfaces 79 and 80 defining the upper and lower portions thereof as best shown in FIG. 6. The tapered cam surfaces 79 of each of the flexible ribs 77 are positioned for contact with the annular tapered cam surface 68 defined at the lower portion of the detent nut 62. The lower cam surfaces 80 of each of the flexible ribs are positioned for contact with the tapered, frusto-conical cam surface 66 defined at the upper portion of the detent nut.

As a force is developed by the cam surfaces of the detent nut against either of the upper or lower cam surfaces 79 and 80, the flexible ribs 77 will be deflected radially outwardly as shown in FIG. 5. Upon the development of sufficient force to achieve maximum deflection of the flexible ribs, the detent nut 62 will pass through the opening defined collectively by a plurality of segmented internal surfaces 81 of the ribs. This activity releases the stinger or wash pipe 16 and thereby allows telescoping movement of the inner and outer tubular parts of the jar mechanism. The release force will then be transmitted in the form of a jarring force having a controlled magnitude defined by the magnitude of the release force. It should be borne in mind that the taper of the cam surfaces 79 and 80 cause the development of differing release forces, depending upon the direction of force application. As the drill pipe is pulled upwardly by the draw works of the drilling rig, the detention cage is moved upwardly thereby forcing the cam surface 79 against the cam surface 68 of the detent nut. These abrupt reacting tapered surfaces cause the development of a significant force magnitude in order to flex the rib elements 77 outwardly as shown in FIG. 5 sufficiently to force the detent nut past the detents of the ribs. Conversely, upon downward movement of the drill pipe with the detent nut positioned below the detent elements 78, the reaction forces developed by the gradually tapered cam surfaces 66 and 80 is such that less force is required to force the detent nut 62 past the detents 78. Thus, differing release forces are developed, depending upon the particular direction of drill stem movement that is occurring. It should be borne in mind that the detent release mechanism defined by the detention cage and its relationship with the detent nut of the wash pipe may be utilized in conjunction with or independently of the locking and release mechanism defined by the lugs 36 and grooves 29 of the drilling jar mechanism. With the lugs 36 oriented in such manner that linear telescoping movement of the drilling jar mechanism is allowed, operation of the detent release mechanism will occur only when sufficient linear movement takes place to shift the detent nut 62 past the detents 78 of the flexible ribs. Operating personnel of the drilling rig may, therefore, utilize the respective release mechanisms to develop both upwardly and downwardly directed jarring activity and may also efficiently control the magnitude of the jarring forces that occur. Differing jarring characteristics are, therefore, provided that enable drilling personnel to efficiently utilize the drilling jar mechanism for releasing stuck drill pipe.

It should also be borne in mind that the detent release mechanism of the drilling jar is not field adjustable. The load limits of the detention system are controlled by the length of the flexible rib elements 77 which establish the force necessary for yielding the spring-like rib elements radially outwardly as the detent nut is forced past the detents 78. In order to change the release force of the detent mechanism, it is necessary to disassemble the jar mechanism and remove both the spacer sleeve 71 and the detention cage 72. Thereafter, a spacer sleeve and a detent cage of differing lengths may be inserted into the chamber or receptacle defined by the passage 15. The longer or shorter detent cage will cooperate with the detent nut to allow release to occur upon application of predetermined forces. For example, a release force range in the order of 20,000; 30,000; 40,000 or 50,000 pounds hook load above dead weight during jarring activity may be required to activate various detent release mechanisms. The particular load limits that are required may be employed in conjunction with drilling jar tools of differing size and load requirements. There is developed, therefore, a drilling jar mechanism having the capability of developing jarring activity simply by unlocking the primary jar mechanism and actuating it by means of a straight pull. The jar mechanism has a manual override system enabling drilling personnel to selectively employ the different jarring functions of the apparatus or to utilize them in combination to achieve desired jarring activity.

The foregoing is directed to the preferred embodiment, but the scope of the present invention is determined by the claims which follow.

I claim:

1. A drilling jar for use with a drill string to assist in unsticking the drill string, comprising:

(a) upper and lower hollow mandrels having at least portions thereof in telescoping relation one within the other for relative linear telescoping movement, said mandrels each being adapted for connection to drill pipe of said drill string and forming cooperative abutment means for force transmission from one of said mandrels to the other, said upper and lower mandrels further cooperating to define wall means forming a detent release receptacle;

(b) an upper stinger pipe axially communicated with said lower mandrel and telescoped in said upper mandrel;

(c) radially yieldable detent means being positioned within said detent release receptacle and defining detent means, said detent means defining cam surface means;

(d) a detent engaging head positioned at an upper extremity of said stinger pipe defining cam means for actuating engagement with said cam surface means of said detent means, said detent means yielding radially upon application of a predetermined linear force to said mandrels in response to camming actuation of said detent means by said detent engaging head and releasing said upper and lower mandrels and causing said abutment means to be brought into force transmitting slamming engagement at a force corresponding with said linear force; and (e) a lock and release mechanism for selectively locking the drilling jar in a drilling position or releasing the drilling jar to impart a jarring impact to the drill string.

2. The apparatus of claim 1, wherein said detent means comprises:

(a) a plurality of detents being positioned in generally circular orientation; and (b) said cam surface means of said detent engaging head being frusto-conical surfaces which are adapted for simultaneous engagement with said plurality of detents.

3. The apparatus of claim 1, wherein said detent means comprises:

an elongated annular cage being defined by a plurality of flexible ribs oriented in generally parallel relation, each of said ribs defining a detent positioned intermediate the length thereof, said detents being positioned in circular orientation.

4. The apparatus of claim 3, wherein said detent means includes:

(a) upper and lower generally circular elements; and (b) said ribs being connected at the upper and lower extremities thereof to said circular elements and being positioned in spaced relation with said wall means of said detent release receptacle.

5. The apparatus of claim 4, including:

spacer sleeve means being positioned within said detent release receptacle in end to end relation with said detent means, the release force necessary to yield said detent means and release said telescoping mandrels for jarring movement being determined by the relative lengths of said detent means and spacer sleeve means.

6. The apparatus of claim 1, wherein said detent means comprises:

(a) a plurality of detent projections being oriented in generally circular manner, each projection having upper and lower tapered cam surfaces defined thereby; and (b) said detent engaging head defining upper and lower cam surfaces for engagement with respective ones of said cam surfaces of said detent projections, said cam surfaces of said detent projections and detent engaging head cooperating to induce radial yielding of said detent means during both upward and downward movement of said detent engaging head.

7. The apparatus of claim 6, wherein:

the release force required for radial yielding of said detent means differs depending upon the direction of linear movement of said detent engaging head and controlled force jarring activity occurs upon both upward and downward movement.

8. A drilling jar for use with a drill string to assist in unsticking the drill string, comprising:

(a) an upper hollow mandrel having (1) connector means enabling said upper mandrel to be connected into a drill string;

(2) a packer therein for sealing against a member inseated thereinto;

(3) a lower shoulder on said mandrel useable as a hammer;

(4) first and second spaced encircling internal grooves separated by a land in the lower portion of said mandrel;

(5) a transverse shoulder interrupting said encircling grooves;

(6) a transverse groove across said land, said transverse groove cooperating with said land to define a spline rib parallel to the axis of said upper mandrel;

(b) a lower hollow mandrel having (1) an upper stinger pipe axially communicated with said lower mandrel and telescoped into said packer for sliding and sealing movement in said upper mandrel;

(2) an upwardly facing shoulder adopted to be used as an anvil and arranged on said lower mandrel for hammering by said lower shoulder on said upper mandrel;

(3) connector means at the lower end of said lower mandrel enabling said lower mandrel to be connected to the lower portions of a drill string;

(4) a protruding lug extending from said lower mandrel and having a profile such that said lug fits into either of said internal grooves and can rotatably move in said groove until movement carries said lug against said transverse shoulder whereupon said lug is constrained by said shoulder against further rotation in said grooves on drilling where the drill string turns to the right so that said upper hollow mandrel and said lower hollow mandrel rotate together as a unit; and where said lug is moved away from said transverse shoulder and moves into alignment with said transverse groove wherein said lug has a profile to enable said lug to slidably move along said transverse groove as said upper and lower mandrels are telescoped relative to one another;

(5) said lug moving between said first and second encircling grooves on telescoping movement wherein the travel of said lug is equal to the stroke of said upper mandrel as it hammers against said lower mandrel to impart a jarring impact to the drill string;

(c) said upper and lower mandrels cooperating to define wall means forming a detent release receptacle;

(d) radially yieldable detent means being positioned within said detent release receptacle and defining detent means, said detent means defining cam surface means; and (e) a detent engaging head being provided at one extremity of the inner one of said telescoping mandrels and defining cam means for actuating engagement with said cam surface means of said detent means, said detent means yielding radially upon application of a predetermined linear force to said mandrels in response to camming actuation of said detent means by said detent engaging head and releasing said upper and lower mandrels and causing said abutment means to be brought into force transmitting slamming engagement.

9. The apparatus of claim 8 including sufficient length on said stinger pipe to permit a stroke of twice the spacing between adjacent spaced internal grooves of said upper mandrel.

10. The apparatus of claim 9 including a first and second threaded portions of said upper mandrel which join and separate adjacent to said packer to enable said upper mandrel to be opened adjacent to said packer to permit access to said packer and wherein said packer includes at least a plurality of seals and a means for compressing said seals.

11. The apparatus of claim 10 including an enlarged axial passage in said upper mandrel for receiving said stinger pipe which enlarged passage extends there along by a length to receive said stinger pipe on its maximum stroke.

12. The apparatus of claim 11 including a narrow passage axially concentric with said enlarged passage.

13. The apparatus of claim 12 including a pin and box connection comprising said connector means on said upper and lower mandrels.

* * * * *